US008066406B2

(12) United States Patent
Boyer et al.

(10) Patent No.: US 8,066,406 B2
(45) Date of Patent: Nov. 29, 2011

(54) OPTIC POSITIONING DEVICE

(75) Inventors: John D. Boyer, Lebanon, OH (US); Mark C. Reed, West Chester, OH (US)

(73) Assignee: LSI Industries, Inc., Cincinnati, OH (US)

( * ) Notice: Subject to any disclaimer, the term of this patent is extended or adjusted under 35 U.S.C. 154(b) by 267 days.

(21) Appl. No.: 12/253,596

(22) Filed: Oct. 17, 2008

(65) Prior Publication Data

US 2009/0103299 A1 Apr. 23, 2009

Related U.S. Application Data

(60) Provisional application No. 60/981,984, filed on Oct. 23, 2007.

(51) Int. Cl.
*F21V 17/10* (2006.01)
*F21V 3/00* (2006.01)

(52) U.S. Cl. ..... 362/249.02; 362/244; 362/311.02; 362/455; 362/456

(58) Field of Classification Search ..... 362/217.01, 362/225, 240, 329, 244, 249.02, 249.11, 362/223, 310, 311.02, 455, 456; 359/819, 359/827

See application file for complete search history.

(56) References Cited

U.S. PATENT DOCUMENTS 4,935,665 A 6/1990 Murata
4,941,072 A 7/1990 Yasumoto et al.
6,244,727 B1 6/2001 Ryan, Jr. et al.
6,481,130 B1 * 11/2002 Wu ..... 40/546
6,547,430 B2 * 4/2003 Dinant ..... 362/547
6,559,439 B1 * 5/2003 Tsuchida et al. ..... 250/239
6,561,690 B2 * 5/2003 Balestriero et al. ..... 362/555
6,616,291 B1 9/2003 Love
6,878,972 B2 4/2005 Waalib-Singh (Continued)

FOREIGN PATENT DOCUMENTS

WO WO2006/090858 A1 8/2006

(Continued)

OTHER PUBLICATIONS

International Search Report and the Written Opinion from corresponding PCT application No. PCT/US2008/080328 dated Dec. 24, 2008.

(Continued)

*Primary Examiner* — Peggy A. Neils
(74) *Attorney, Agent, or Firm* — McDermott Will & Emery LLP

(57) ABSTRACT

A device for holding and positioning an optic, such as a refractive lens, over a light source such as a light emitting diode. The refractive lens is frustum-shaped with an upper light-exiting end having an upper rim, a lower light-entering end, and a conical sidewall that tapers from the upper rim to the lower end. The device has a channel including a base and first and second sidewalls extending from the opposed side edges of the base, and further having one or more optic holding positions. The optic holding position includes an aperture formed in the base that is configured to receive the conical sidewall of the optic, and an aperture formed in a portion of each sidewall, adjacent the aperture in the base, for retaining a portion of the upper rim of the optic lens. The aperture can include a slot opening through which a portion of the upper rim of the optic lens at least partially extends.

9 Claims, 5 Drawing Sheets

U.S. PATENT DOCUMENTS

| | | | | |
|---|---|---|---|---|
| 7,002,758 | B2 * | 2/2006 | Uno et al. | 359/819 |
| 7,008,079 | B2 | 3/2006 | Smith | |
| 7,066,733 | B2 * | 6/2006 | Logan et al. | 433/29 |
| 7,159,997 | B2 | 1/2007 | Reo | |
| 7,281,820 | B2 * | 10/2007 | Bayat et al. | 362/245 |
| 7,307,391 | B2 * | 12/2007 | Shan | 315/291 |
| 7,410,275 | B2 * | 8/2008 | Sommers et al. | 362/335 |
| 7,684,132 | B2 * | 3/2010 | Watanabe | 359/819 |
| 7,717,589 | B2 * | 5/2010 | Nishioka et al. | 362/293 |
| 7,760,971 | B2 * | 7/2010 | Chien | 385/14 |
| 7,878,683 | B2 * | 2/2011 | Logan et al. | 362/249.02 |
| 2002/0067556 | A1 * | 6/2002 | Miyakawa | 359/819 |
| 2005/0201091 | A1 * | 9/2005 | Kramer et al. | 362/249 |
| 2006/0061999 | A1 | 3/2006 | Sommers et al. | |
| 2006/0146531 | A1 | 7/2006 | Reo | |
| 2007/0091618 | A1 | 4/2007 | Belek | |
| 2007/0236937 | A1 | 10/2007 | Chao et al. | |
| 2009/0168419 | A1 | 7/2009 | Daimon | |

FOREIGN PATENT DOCUMENTS

| | | | |
|---|---|---|---|
| WO | WO2005053041 | * | 9/2006 |
| WO | WO 2007/030542 A2 | | 3/2007 |
| WO | WO2007/090292 A1 | | 8/2007 |

OTHER PUBLICATIONS

Response to Office Action dated Apr. 19, 2011 from corresponding Chinese Application No. 200880011073.3.

Office Action dated Feb. 8, 2011 from corresponding Australian Application No. 2008317040.

English Translation of Office Action dated Feb. 23, 2011 from corresponding Chinese Application No. 200880011073.3.

New Zealand Patent Application No. 584489, Examination Report, dated Jul. 14, 2011, Intellectual Property Office New Zealand.

* cited by examiner

OPTIC POSITIONING DEVICE

FIELD OF THE INVENTION

The present invention relates generally to a lighting apparatus and, more particularly, to a device for positioning optics to distributing light from one or more light sources. The present invention is particularly useful for distributing light emitted from one or more light emitting diodes (LEDs), as described herein, but is directed to distributing light generated by any type of light source.

BACKGROUND OF THE INVENTION

As the quality and energy efficiency of LEDs have improved, the production cost of LEDs has gone down, and LEDs are being commonly used in area lighting applications. Initial efforts to incorporating LEDs into lighting fixtures have involved retrofitting LEDs into conventional luminaires or onto or into the shape of conventional lighting lamps.

Some LEDs emit light in a substantial lambertian pattern. To direct the light from such an LED, it is a usual practice to capture at least low angle light from the LED with an optic, such as a refracting lens, and to direct this light in a desired direction and pattern. Lens and/or reflectors are commonly employed optics. The body of the LED device or the printed circuit board ("PCB") on which the LED is mounted or created commonly supports the lens, with the assistance of support legs or the like. An optical lens is commonly affixed to the LED device or to the PCB one lens at a time, and in an irreversible manner, in that removal of an lens (if, for example, improperly installed) usually results in breaking the legs or other element involved in mounting. Therefore, there remains a need to provide improved and effective manner of, in general, associating optics with light sources and incorporating LEDs lighting elements into lighting apparati and luminaires.

SUMMARY OF THE INVENTION

The present invention relates to a device for holding and positioning at least one, and typically a plurality of, optics for association with one or more light sources, which will be described in the preferred embodiment here as an array of LEDs.

The device comprises a channel that includes a base portion having an aperture that is configured to receive therethrough a first end of an optic to prevent movement of the optic in a first axial direction, and opposed sidewall portions extending from opposed sides of the base portion, each configured to retain opposed portions of the upper rim of an optic to prevent movement of the optic in a second axial direction. The sidewalls may extend normal to the base or can be biased at an angle from normal inwardly or outwardly. The sidewalls may be formed integrally with the base as a unit, such as by folding a planar member along lines to form the base and the sidewalls.

In one aspect of the invention, the device includes at least one, and more typically a plurality of, optic holding positions. The device may be elongated with a plurality of optic holding positions along its length, as shown and described herein.

In another aspect, the optic includes a frustum-shaped lens for refracting light emitted from an associated LED into a predetermined pattern, the lens having an upper light-exiting end having an upper rim, a lower light-entering end that typically includes a cavity, and a conical sidewall that tapers from the upper rim to the lower end. The aperture formed through the base at the optic holding position is typically round and has a circular edge that matches the typically round circumference of the frustum-shaped lens. When the optic is disposed within the channel, between the sidewalls, having its light-entering end extending through the aperture of the base, the circular edge of the aperture engages the conical sidewall of the optic at a circular interface preventing further movement of the optic in the axial direction (denoted herein as −Z direction). The circular edge of the aperture also inhibits lateral (denoted herein as ±X direction) movement and longitudinal (denoted herein as ±Y direction) movement of at least of the light-entering end of the optic.

Each opposed sidewall portion is configured to retain the light-exiting end of the optic from movement in the +Z direction, and can also inhibit lateral (±X direction) movement, or longitudinal (±Y direction) movement, or both, of the light-exiting end of the optic when held in the device.

In yet another aspect of the invention, the light-exiting end of each optic is retained by a slot opening formed into each sidewall, adjacent the aperture of the base. If the optic is annular and frustum-shaped, the slot opening has an upper edge that engages the upper rim of the optic lens, which is typically a linear segment, and a curved lower edge that intersects the upper edge and provides clearance for, and typical engagement with, a portion of the conical sidewall of the optic. Alternatively, each slot opening can be rectangular, triangular, or other shape, and the upper edge need not be linear, but can be curved or irregular in shape. When the frustum-shaped optic lens is manipulated into and within the channel at the optic holding position, with its light-entering end extending through the aperture of the base, a portion of the upper rim of the optic extends at least partially through each slot opening, whereby the upper edges of the slot opening retains the optic from movement in the +Z direction. Typically, each sidewall portion is rigidly fixed to, and optionally integrally with, the base portion of the channel. The material of the device is preferably sufficiently flexible to allow the sidewalls to flex outwardly, away from the other sidewall, sufficiently to allow the opposed rim portions of the optic to pass beyond the distal edges of the sidewalls and into or through the slot openings facilitating insertion and removal of the optic.

In yet another aspect of the invention, one or both of the sidewalls can have an optional flange portion extending from its distal edge, typically outwardly relative to the central base. One or both outwardly extending flange portions can be associated with an adjacent second channel having one or more additional of optic holding positions, in order to form a matrix of optic holding positions.

In a further aspect of the invention, the sidewall can include at its distal edge an inwardly-extending upper flange that extends from the distal edge of the sidewall, and extends over a portion of the upper rim, and typically at least a portion of the light-exiting face of the optic. The edge of the inwardly-extending upper flange can be curved to conform to the shape of the optic rim, to limit the area of the light-exiting face that is covered by the flange. The sidewalls in this aspect are typically spaced apart a distance greater than the diameter of the optic rim.

In an additional aspect of the invention, the base and sidewalls can be formed as a curved unitary surface having a lower base portion in which the aperture is formed, and opposed upper side portions in which are formed the slot openings, as described above, or from which extend the upper flange, as described above.

In yet a further aspect of the invention, the device of the present invention is removably secured to one or more light sources such as, for example, a substrate having a plurality of LEDs.

The invention also relates to the ornamental shape and design of the optic holding and positioning device, as shown in the figures.

DETAILED DESCRIPTION OF THE INVENTION

Figures 1, 2, 3:
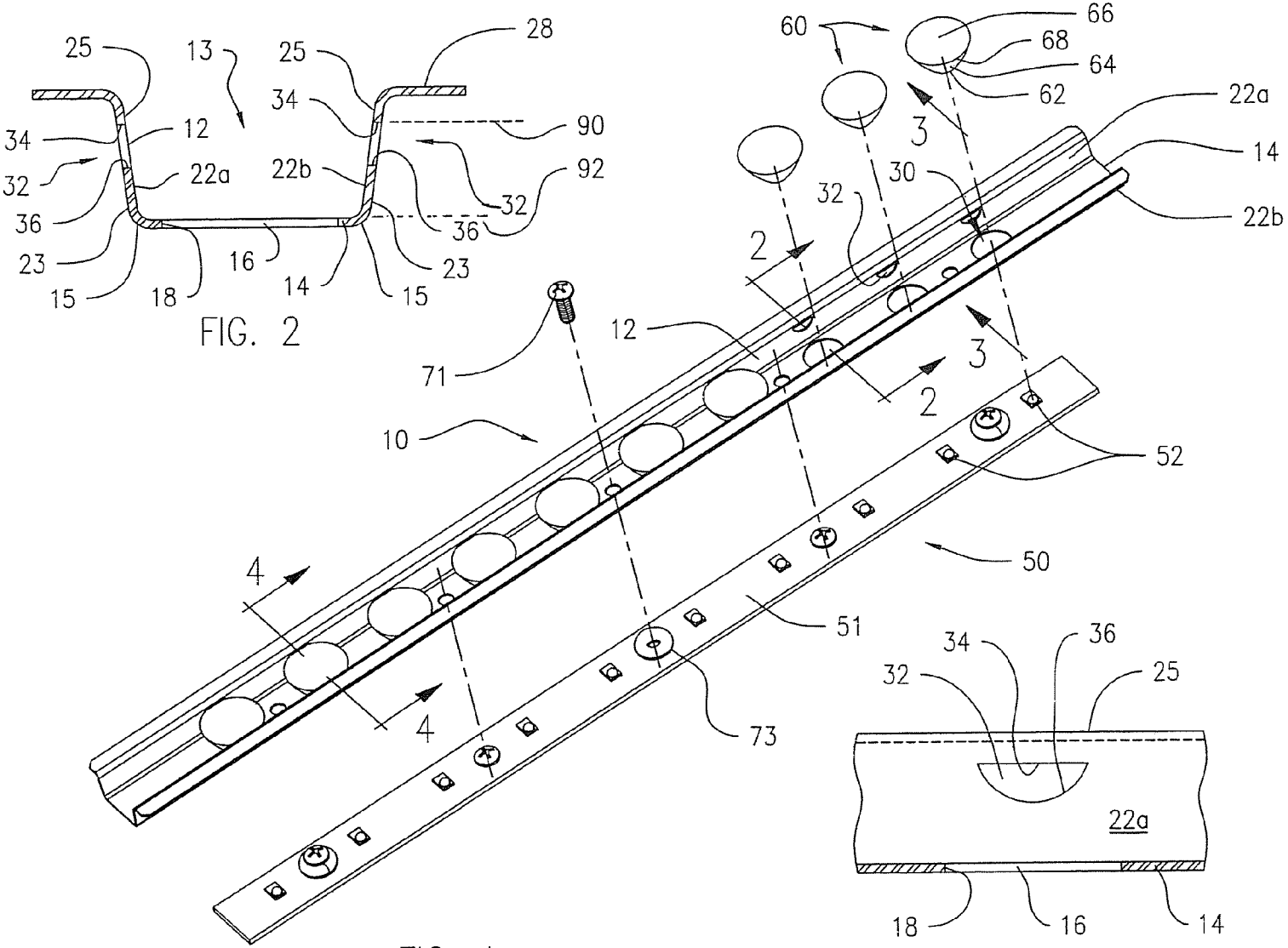
FIG. 1 shows an exploded view of one embodiment of the present invention comprising a LED lighting assembly including an optic holding and position device holding a plurality of optic lenses, which is positionable onto an LED light board.
FIG. 2 shows a lateral cross sectional view of an optic holding position of the optic holding and position device of FIG. 1, taken through line 2-2 of FIG. 1.
FIG. 3 shows a longitudinal cross sectional view of an optic holding position of FIG. 1, taken through line 3-3 of FIG. 1.
Figure 8:
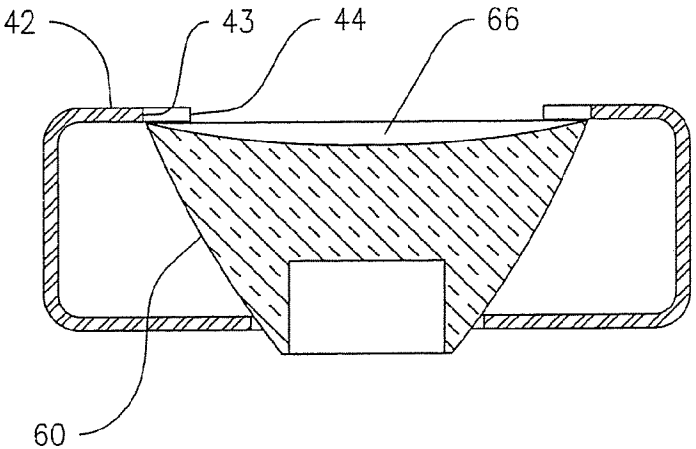
FIG. 8 shows a lateral cross sectional view of an optic holding position of the second embodiment of the optic holding and position device with an optic lens, taken through line 8-8 of FIG. 5.

FIGS. 1-4 show a first embodiment of the optic holding and positioning device 10, having an elongated channel member 12 that includes an elongated planar base 14, opposed first and second side edges 15, and opposed first sidewall 22*a* and second sidewall 22*b*, each sidewall having a proximal edge 23 extending from the respective first and second side edges 15 of the base 14, and a distal edge 25. The sidewalls 22*a*, 22*b* are tilted slightly outwardly. The sidewalls may, but need not, be formed integrally with the base as a unit, such as by folding a planar member (e.g. sheet metal). The base 14 and sidewalls 22*a*, 22*b* may be formed by other methods as will be evident to those of ordinary skill in the art. The device 10 also includes at least one optic holding position. Each optic holding position includes the aperture 16 formed in and through the base 14, and opposed slot openings 32 formed, one each, in the respective opposed sidewalls 22*a*, 22*b*, adjacent transversely to the aperture 16 formed in the base.

The aperture 16 formed through the base at each optic holding position is round and has a circular edge 18 to conform to the frustum shaped optics 60 depicted in the Figures. When the optic 60 is disposed within the channel 12, between the sidewalls, having its light-entering end 62 extending through the aperture 16 of the base, the circular edge 18 engages the circumference of the conical sidewall 64 of the optic 60 at a circular interface 67, preventing further axial movement of the optic in the axial direction (denoted herein as −Z direction). The circular edge 18 of the aperture 16 also inhibits lateral (denoted herein as ±X direction) movement and longitudinal (denoted herein as ±Y direction) movement of at least of the light-entering end of the optic 62. The circular edge 18 of the aperture 16 therefore provides positioning of the light-entering end of the optic 62 relative to the LED or other light source with which the optic 60 is positionally associated, in the X-Y plane, and in the Z direction. If the perimeter of the optic 60 has a non-circular shape, the shape of each associated aperture 16 may likewise vary from circular to conform to the shape of the optic 60. In one embodiment, the optic 60 are comprised of a PLN 19306 lens available from Khatod and one or more of the LEDs are comprised of a Nichia NS6W-083 series LED.

Figure 4:
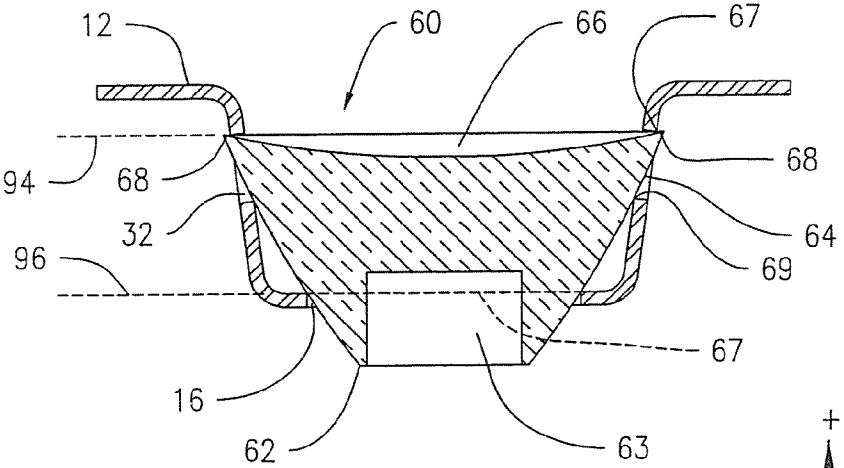
FIG. 4 shows a lateral cross sectional view of an optic holding position of the optic holding and position device of FIG. 1 with an optic lens, taken through line 4-4 of FIG. 1.

The slot opening 32 is formed into and through each sidewall, transverse to and adjacent the aperture 16 of base. Each slot opening 32 has an upper edge 34 that is a linear segment that engages the upper rim 68 of the optic, and a lower edge 36 that is typically convexly curved away from the upper edge 34 to engage a portion 69 of the conical sidewall 64 of the optic 60, such that the slot opening 32 resembles a crescent shape. When the optic 60, as depicted in FIG. 4, is disposed within the trough 13 defined by the channel 12 between the sidewalls 22*a*, 22*b* with its light-entering end 62 extending through the aperture 16 of the base, a portion of the upper rim 68 of the optic 60 extends through each slot opening 32, whereby the upper edges 34 of the slot openings 32 restrain the optic 60 from movement in the +Z direction. The upper edges 34 of the slot openings 32 in the opposed sidewalls 22*a*, 22*b* are formed in a plane 90 that is offset from the plane 92 (see FIG. 2) of the top surface of the base 14 by a distance that is slightly larger than the distance between the plane 94 of the optic rim 68 and a plane 96 passing through the circular interface 67 on the circumference of the optic's conical sidewall 64 (see FIG. 4). This slightly larger distance allows an optic 60 to be position downward into the aperture 16 of the base, with sufficient clearance of the rim 68 below the upper edge 34 of the slot openings 32. Typically, each sidewall 22*a*, 22*b* is rigidly fixed with the base 14, but can be flexed outwardly away from the other sidewall sufficiently to allow the opposed rim portions 68 of the optic 60 to pass by the distal edges 25 and into the slot openings 32. One or both of the sidewalls 22*a*, 22*b* may also be flexed outwardly to remove an optic 60 from the device 10 without destruction of the optic or the associated light board or light sources. The sidewall 22*a*, 22*b* having the slot opening 32 can have an optional flange portion 28 integral with and extending from its distal edge 25, typically outwardly relative to the central base 14. The optional flange portion 28 may be employed to facilitate mounting of the device 10 or manipulation of the device 10 during its installation or the installation or removal of optics 60. The slot opening 32 described and depicted is only one manner of securing an optic 60 in the device 10. Other manners include attachment of additional structure to receive the optic 60 or mechanically attaching the optic 60 such as by screw, adhesive, etc. In one such manner, slot opening 32 may be eliminated and the optics held by friction against sidewalls 22*a*, 22*b* or by securement to the base 14 such as, for example only, by adhesive.

FIGS. 5-8 show a second embodiment of the optic holding and positioning device 10, wherein the sidewalls 122*a*, 122*b* have an inwardly-extending upper flange 42 that extends from the distal edge 25 of the first and second sidewalls 122*a*, 122*b* over the rim 68 of the optic 60 and at least a portion of the light-exiting face 66 of the optic 60. The distal edge of the inwardly-extending upper flange 42 is shown having a plurality of inwardly (convexly) curved portions 43 toward the distal edge 25, separated by a plurality of outwardly extending portions 44. The inwardly (convexly) curved portions 43 conform to the curved shape of the optic rim 68, to limit the area of the light-exiting face 66 that is covered by the flange 42. The sidewalls 122*a*, 122*b* in this embodiment do not require the slot openings 32 of the embodiment of FIGS. 1-4 to restrain the optic 60 in the longitudinal +Y direction. The sidewalls 122*a*, 122*b* can be spaced apart a distance greater than the diameter of the optic rim, while retaining and enclosing the optic(s) within the trough 13. Installation and removal of optics 60 can be accomplished by flexing one or both of the sidewalls 122*a*, 122*b* to allow the optic 60 to clear the flange 42.

Figure 9:
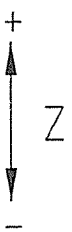
FIG. 9 shows a third embodiment of an optic holding and position device.
Figure 9:
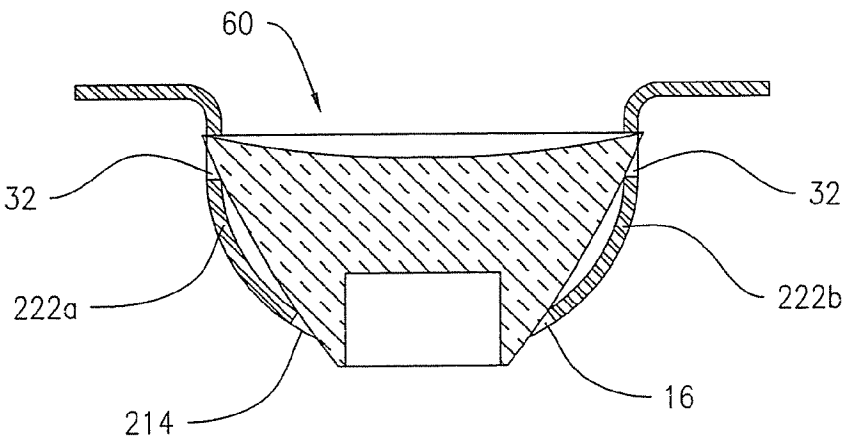
Figures 5, 6, 7:
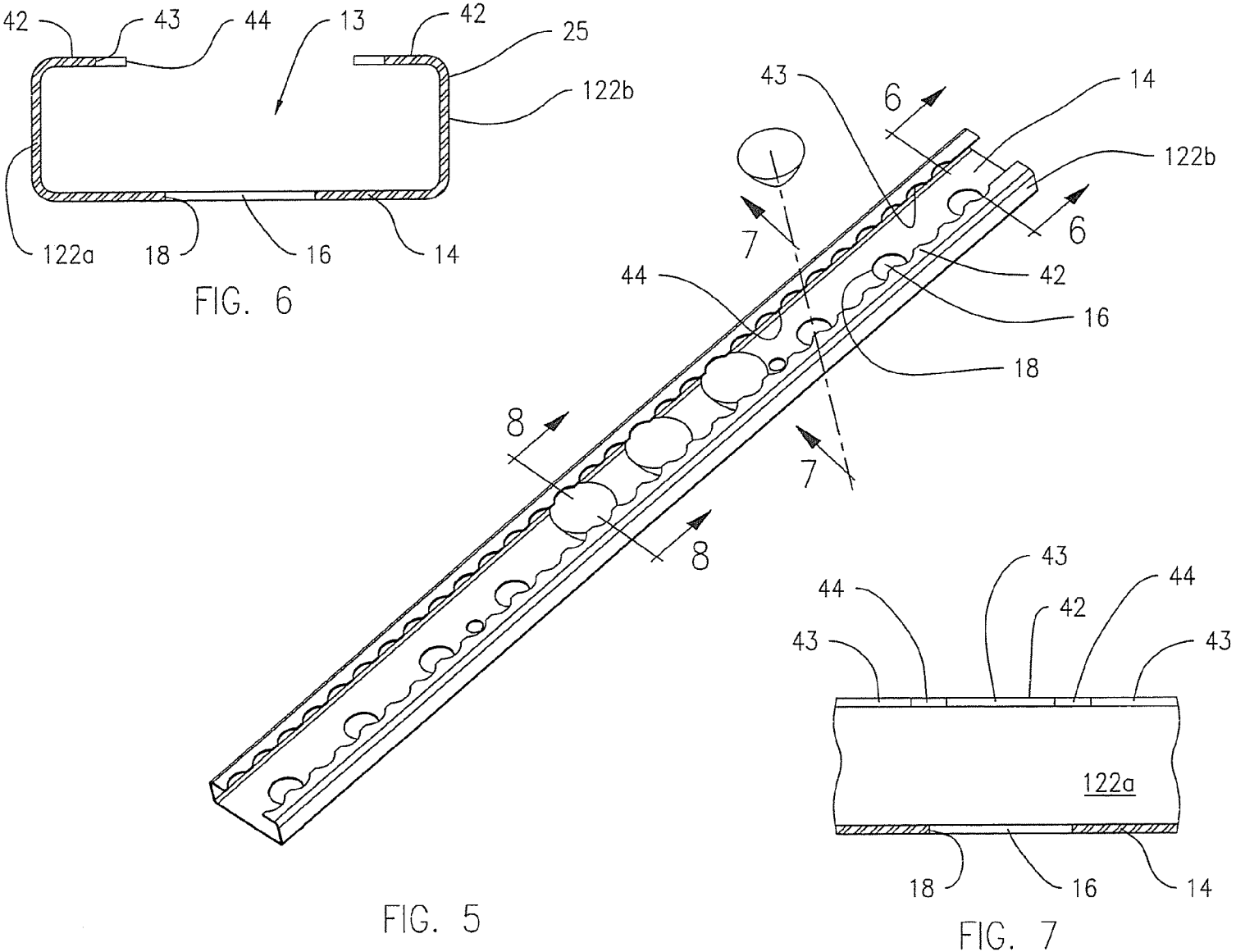
FIG. 5 shows a second embodiment of the optic holding and position device of the present invention holding a plurality of optic lenses.
FIG. 6 shows a lateral cross sectional view of an optic holding position of the second embodiment of the optic holding and position device, taken through line 6-6 of FIG. 5.
FIG. 7 shows a longitudinal cross sectional view of an optic holding position of the second embodiment of the optic holding and position device, taken through line 7-7 of FIG. 5.

FIG. 9 depicts yet another configuration of device 10 in which the trough 13 is formed of a curved base 214 and walls 222*a*, 222*b* rather than flat as in the embodiment depicted in FIGS. 1-4, but employs the slot openings 32 in the same manner and for the same purposes.

Figure 11:
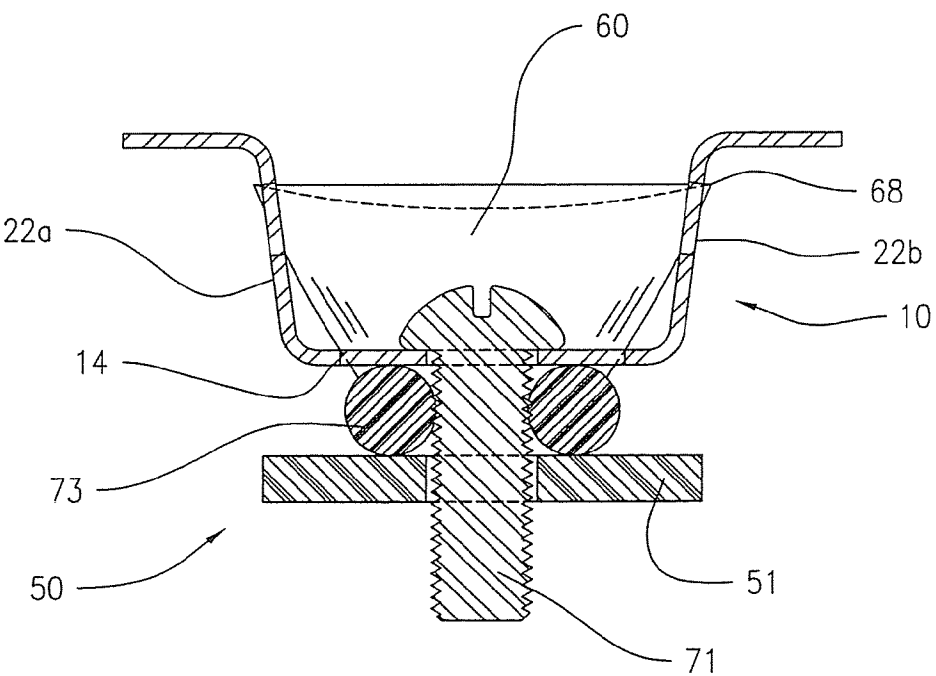
FIG. 11 shows a lateral cross sectional view of the LED lighting assembly of FIG. 10, taken through line 11-11 of FIG. 10.
Figure 10:
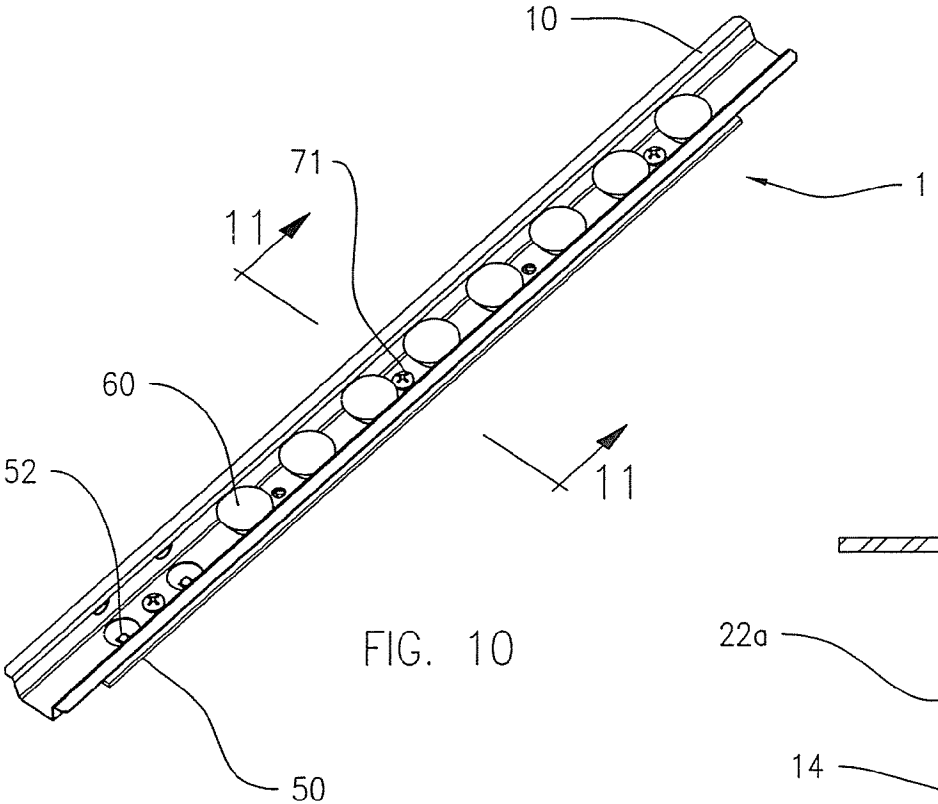
FIG. 10 shows an LED lighting assembly including the optic holding and positioning device of FIG. 1 associated with an LED light board.
Figure 12:
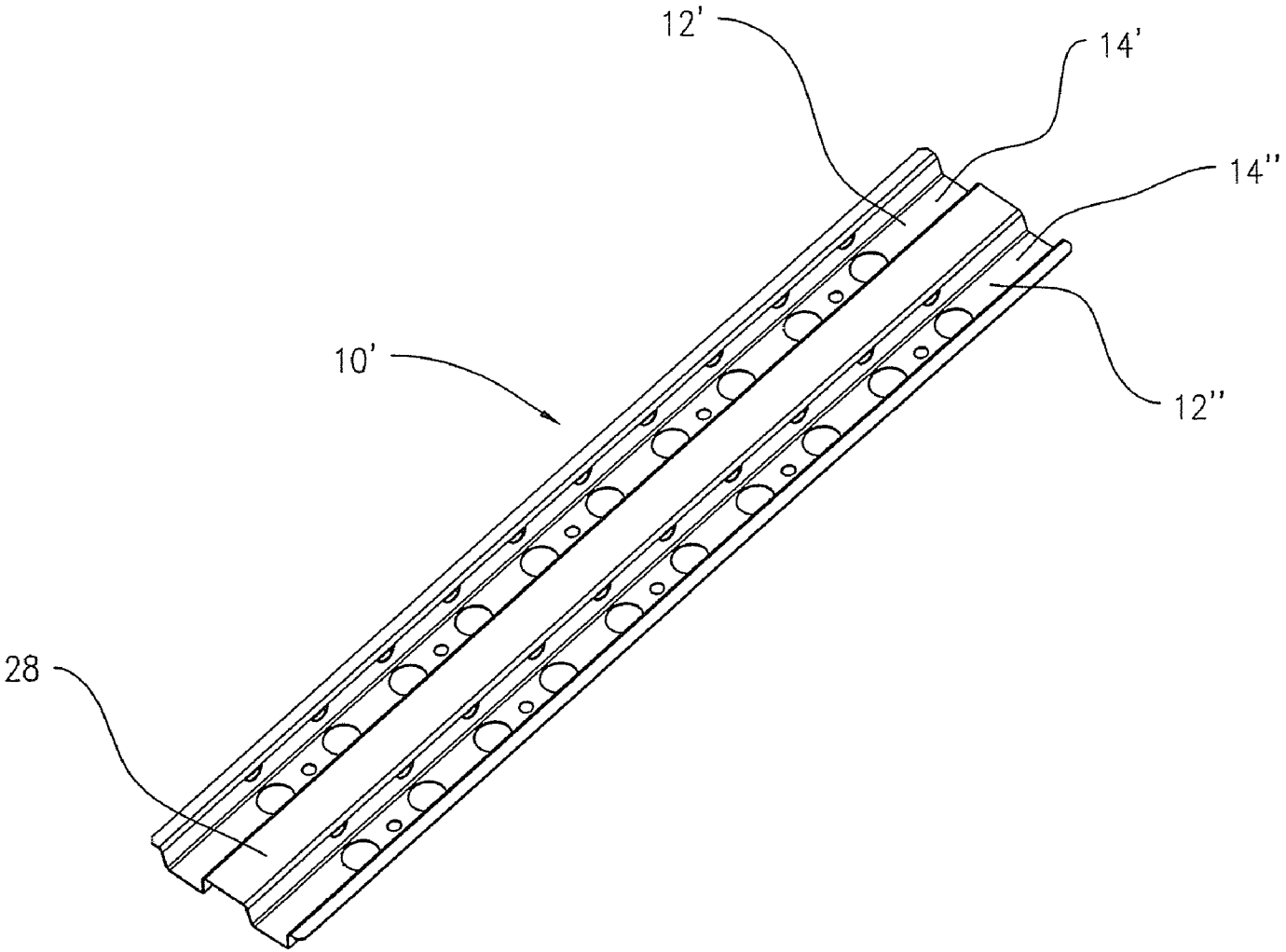
FIG. 12 shows a fourth embodiment of an optic holding and position device comprising two channels of the configuration depicted in FIGS. 1-4, integrally connected to facilitate a lighting assembly having a two dimensional array of LEDs with associated optic lenses.

The optic holding and positioning device 10 can be secured in position over an LED light board 50 to affix and position the array or matrix of optics 60 over respective LEDs 52, to form an LED light assembly 1 as shown in FIGS. 10 and 11. The LED light board 50 typically comprises a substrate 51 on which is mounted at least one LED 52, though more typically a plurality of LEDs 52. The substrate 51 can be configured to position the plurality of LEDs disposed on or created therein in a linear or curved array, or in a matrix having a plurality of linear or curvilinear rows, or in any conceivable matrix or pattern. The LED can be of any kind and capacity. In one embodiment Nichia NS6W-083 series LEDs may be employed. Other LEDs are contemplated.

The substrate 51 is typically a light board, and more typically a PCB. The circuitry for controlling and powering the LEDs can also be mounted or created on the PCB, or located remotely. In one suitable embodiment, the LEDs 52 are white LEDs each comprising a gallium nitride (GaN)-based light emitting semiconductor device coupled to a coating containing one or more phosphors. The GaN-based semiconductor device emits light in the blue and/or ultraviolet range, and excites the phosphor coating to produce longer wavelength light. The combined light output approximates a white output. For example, a GaN-based semiconductor device generating blue light can be combined with a yellow phosphor to produce white light. Alternatively, a GaN-based semiconductor device generating ultraviolet light can be combined with red, green, and blue phosphors in a ratio and arrangement that produces white light. In yet another suitable embodiment, colored LEDs are used, such are phosphide-based semiconductor devices emitting red or green light, in which case the LED light board 50 produces light of the corresponding color. In still yet another suitable embodiment, if desired, the LED light board includes red, green, and blue LEDs distributed on the PCB in a selected pattern to produce light of a selected color using a red-green-blue (RGB) color composition arrangement. In this latter exemplary embodiment, the LED light board can be configured to emit a selectable color by selective operation of the red, green, and blue LEDs at selected optical intensities.

In a typical embodiment, the substrate 51 comprises a PCB such as an FR4 board, and a metal core sheet or strip that is laminated to the FR4 board with thermally-conductive adhesive or epoxy. The metal core strip is typically bonded to the planar base, such as the floor of a recess, with a thermally-conductive adhesive to secure the substrate 51 to the planar base. FR4, an abbreviation for Flame Resistant 4, is a composite of a resin epoxy reinforced with woven fiberglass mat. The metal core aids in heat dissipation from the LED. The LED itself typically has a specialized slug integrated with the LED casing to conduct heat produced by the interior die away from the LED, as is well known in the art. The FR4 board typically has a top layer of copper that can include a network of flattened copper connectors or traces for making electrical connections between component and for conducting heat away from the LED.

In an alternative embodiment, the substrate comprises a non-metallic, non-conductive board, typically an FR4 board, but does not include a metal core layer, which is affixed or attached directly to the planar base to provide the heat dissipation function of the metal core. A thermally-conductive adhesive or epoxy as a bead or layer of adhesive bonds the board to the base. Use of the FR4 board without metal core reduces the cost of the LED light board by eliminating the metal core, whose function of transferring heat is assumed by the planar base. In addition, elimination of the metal core opens an opportunity to provide flexible or bendable substrates that can be installed into and or attached onto non-planar, curved surfaces. The substrate can comprise a pair of FR4 boards separated by a second copper or conductive layer. Each of the pair of FR4 boards is typically thinner to minimize resistance to heat transfer, while the second copper or conductive layer enhances heat transfer away from the LED. One of either, or both of, the first copper layer or the second copper layer is the network of copper connectors or traces, while the other is primarily a heat transfer aid.

The device of the present invention has been, to this point, described primarily for use with LED light sources. The device 10 of the present invention can, however, employ any type of light source known to date or hereinafter created.

The device 10 can be spaced a selected distance from the light board 50, which spaces each optic 60 from the associated light source (depicted as LEDs), using a gasket 73 at one or more locations. FIGS. 1 and 11 show a plurality of gaskets 73 disposed between the light board 50 and the device 10, with a threaded bolt 71 passing through a hole in the base 14 of the device 10 to hold the device to the light board 50. The gasket 73 displaces the optic holding and position device 10 a predetermined distance vertically (+Z) from the light board 50 of the light board 50, to position the light-entering end 62 and cavity 63 of the optic lens 60 a predetermined distance above the LED 52. The cavity 63 of the optic lens is preferably concave inward to permit the optic to surround the LED 52, and capture and control as much light emitted by the LED as possible. The concave inward portion of the cavity 63 can have a cylindrical shape, as shown in the figures, or can have a parabolic or other curved shape. The spacing function of the gasket 73 can be accomplished by alternative structures, such as a bushing or other equivalent structures, as will be understood by those of ordinary skill in the art, and typically is made of rubber, plastic or other resilient material, though a metal or hard plastic can also be used.

The optic holding and positioning device 10 is typically formed from a metal or plastic sheet, which is preferably lightweight, flexible when manipulated, and resilient in order to retain its formed shape. In an aspect of the invention, the sheet material of the device is thermally conductive to assist dissipating heat generated by the light sources, and has a reflective surface on the optic side. The thickness of the sheet material is selected to provide sufficient resilience to retain shape, with sufficient flexibility to allow manipulating the optic into the optic holding position. An aluminum sheet is preferred, having at least 10 mil thickness, and more typically about 50 mil to 200 mil thickness, and having a highly reflective surface, such as Miro-4 (minimum 95% reflectance), on the optic-positioning side of the device. Specular aluminum is preferred, although others are contemplated.

In a preferred embodiment, the at least one LED of the LED light board 50 includes a plurality of LEDs in an array. The array can include a straight or curved line of LEDs, a matrix of rows and columns of LEDs, or any other predetermined pattern. The array or matrix of LEDs can be a pattern of regularly or equally-spaced LEDs, or randomly spaced. The LEDs can be disposed in the same X-Y plane, or in a plurality of X-Y planes offset in the Z direction from the other. In accordance with the predetermined pattern of the LEDs, the optic holding and positioning device 10 provides at least one optic holding position, and more typically a plurality of optic holding positions in an array that can be a straight or curved line of positions, or in a matrix of rows and columns of positions, or any other predetermined pattern of positions. The array or matrix of positions can be a pattern of regularly or equally-spaced positions, or randomly spaced positions. The positions can be disposed in the same X-Y plane, or in a plurality of X-Y planes offset in the Z direction from the other.

The LED lighting assembly can be incorporated into a variety of luminaire, including but not limited to the luminaire described in U.S. Provisional Patent Applications No. 60/953,009, No. 60/982,240, and No. 60/980,562, the disclosures of which are incorporated herein by reference.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

We claim:

1. An optic holding and positioning device for removably holding and positioning an optic in association with a light source, the device comprising a channel having a base and first and second sidewalls extending from the base, the device defining at least one optic holding position comprising an aperture formed in the base configured to receive a portion of a sidewall of the optic, wherein at least one of the first and second sidewalls of the channel defines a sidewall aperture for retaining a portion of a rim of the optic proximate a light-exiting end of the optic and the sidewall aperture has an upper linear edge and a lower curvilinear edge that intersects the upper linear edge.

2. The device according to claim 1 wherein the aperture is circular and the optic defines a frustum-shaped lens having a light-exiting end having an upper rim, a light-entering end, and a conical sidewall that tapers from the rim to the light-entering end.

3. The device according to claim 1 wherein the light source is not permanently affixed to the optic.

4. The device according to claim 1 wherein the base and the channel sidewalls are elongated, and wherein the channel comprises a plurality of optic holding positions.

5. The device according to claim 4 wherein the channel sidewalls are integral with the base.

6. The device according to claim 1 wherein both the first and second sidewalls of the channel define a sidewall aperture for retaining a portion of a rim.

7. The device according to claim 1 further comprising a flange extending inwardly from one of the channel sidewalls and over a portion of the light-exiting end of the optic.

8. The device according to claim 1 wherein the light source is an LED.

9. The device according to claim 1, comprising a plurality of the channels.

* * * * *